US006512485B2

(12) United States Patent
Luly et al.

(10) Patent No.: US 6,512,485 B2
(45) Date of Patent: Jan. 28, 2003

(54) MULTI-BAND ANTENNA FOR BUNDLED BROADBAND SATELLITE INTERNET ACCESS AND DBS TELEVISION SERVICE

(75) Inventors: Robert A. Luly, Littleton, CO (US); Erwin C. Hudson, Englewood, CO (US); Kenneth E. Westall, Englewood, CO (US)

(73) Assignee: WildBlue Communications, Inc., Greenwood Village, CO (US)

( * ) Notice: Subject to any disclaimer, the term of this patent is extended or adjusted under 35 U.S.C. 154(b) by 135 days.

(21) Appl. No.: 09/805,300

(22) Filed: Mar. 12, 2001

(65) Prior Publication Data

US 2002/0140617 A1 Oct. 3, 2002

(51) Int. Cl.[7] ..... H01Q 13/00; H01Q 15/02

(52) U.S. Cl. ..... 343/781 CA; 343/753; 343/909; 343/781 P; 343/840

(58) Field of Search ..... 343/781 R, 781 P, 343/781 CA, 837, 840, 909, 753, 836

(56) References Cited

U.S. PATENT DOCUMENTS

| | | | | |
|---|---|---|---|---|
| 3,148,370 A | | 9/1964 | Bowman | 343/756 |
| 3,231,892 A | | 1/1966 | O'Nians et al. | 343/909 |
| 3,394,378 A | | 7/1968 | Williams et al. | 343/909 |
| 3,769,623 A | | 10/1973 | Fletcher et al. | 343/909 |
| 3,842,421 A | | 10/1974 | Rootsey et al. | 343/909 |
| 4,017,865 A | | 4/1977 | Woodward | 343/781 CA |
| 4,160,254 A | | 7/1979 | Wise | 343/909 |
| 4,342,036 A | | 7/1982 | Scott et al. | 343/836 |
| 4,476,471 A | | 10/1984 | Sato et al. | 343/779 |
| 5,130,817 A | | 7/1992 | Wu et al. | 343/781 CA |
| 5,373,302 A | | 12/1994 | Wu | 343/781 P |
| 5,471,224 A | * | 11/1995 | Barkeshli | 343/909 |
| 5,557,292 A | | 9/1996 | Nygren et al. | 343/781 P |
| 5,982,339 A | | 11/1999 | Lalezari et al. | 343/872 |
| 6,049,312 A | | 4/2000 | Lord et al. | 343/781 P |
| 6,087,997 A | | 7/2000 | Cipolla | 343/725 |
| 6,317,093 B1 | * | 11/2001 | Harris | 343/765 |

* cited by examiner

*Primary Examiner*—Hoang Nguyen
(74) *Attorney, Agent, or Firm*—Natan Epstein

(57) ABSTRACT

A multi-band reflector antenna has a main reflector defining a prime focus and a frequency selective surface (FSS) sub-reflector defining an image focus. One or more transmitter or receiver feeds are provided at each of the prime focus and image focus. In one application as a ground satellite terminal, the antenna supports Ka-band two-way broadband Internet access bundled with multi-satellite Ku-band direct broadcast television service (DBS).

15 Claims, 6 Drawing Sheets

MULTI-BAND ANTENNA FOR BUNDLED BROADBAND SATELLITE INTERNET ACCESS AND DBS TELEVISION SERVICE

BACKGROUND OF THE INVENTION

1. Field of the Invention

This invention pertains generally to the field of satellite communications and antennas for satellite ground terminals, and is more specifically directed to multi-band dish antennas.

2. State of the Prior Art

Ka-band satellite data systems provide a very good option to the consumer seeking broadband Internet connectivity where no terrestrial alternatives such as cable or telephone line based broadband service are available. Satellite Internet access is currently available and has found favorable market acceptance. The ability to add a Ku-band high-powered DBS satellite delivered TV service to the Ka-band Internet access offering at minimal added cost to the consumer is expected to make the Internet access service even more compelling. However, the prospect of having two satellite antennas added to the exterior of their homes may be enough to dissuade many customers. In those areas already serviced by DSL and cable Internet access, a lower price and equal-to-better performance of satellite Internet access may not be enough to overcome that customer's reluctance to put a relatively large and expensive satellite antenna on the outside of their home. This might be particularly true if that consumer already has a high-powered DBS dish in place for an existing satellite delivered TV service.

This difficulty could be overcome by providing a small, relatively low cost single dish antenna capable of handling the two-way Ka-band data link as well as reception of one or more Ku-band DBS satellites.

Many existing home terminal DBS satellite terminal antennas are capable of receiving DBS service from two satellites. The small dish reflectors of these antennas have narrow beam width and are limited to reception of satellites which are close to each other along the geostationary arc. The signals from two adjacent satellites are reflected to slightly spaced apart focal points at the dish antenna and are received by two side-by-side feed horns, each positioned at or near one of the focal points. Each horn feeds a separate block down-converter low noise amplifier unit to amplify and convert the high frequency satellite transmissions to lower intermediate frequencies which are delivered via coaxial cable to an indoor DBS receiver close to the TV set for channel selection and other signal processing and control functions. Dual feed satellite TV antennas of this type are in widespread use and the components for these are readily available at low cost due to their high volume manufacture and mature design. Integrated feed horn-with block down-converter LNA modules (LNBF modules) for Ku-band DBS TV reception can be purchased in quantity at low cost.

Ka-band Internet access service requires two-way communication between the ground terminal at the subscriber's location and a data communications satellite in geostationary orbit. Computer keyboard or mouse input from the subscriber is transmitted from the ground terminal antenna to the satellite, which returns the subscriber input to a data center maintained by the access provider and connected to the Internet backbone through appropriate routers and server computers. Data is returned from the Internet to the provider's data center in response to the subscriber's input, from where it is transmitted up to the data satellite which in turn transmits the data to the subscriber's geographical location where the satellite transmission is received by the subscriber's ground terminal antenna. Standard Ka-band satellite communication frequencies are in a 30 GHz band for the uplink from the subscriber antenna to the data satellite and a 20 GHz band for downlink or satellite to ground signal. The Ka-band uplink and downlink signal requirements can be satisfied by a small transmitter/receiver package mounted on the subscriber's antenna.

A single dish solution to Ka-band Internet access bundled with Ku-band DBS reception therefore requires a dish antenna capable of receiving at 12 GHz and 20 GHz and of transmitting at 30 GHz frequencies.

Tri-band operation of a single reflector dish antenna is possible using a so-called co-boresighted tri-band feed to illuminate the reflector dish at each of the three frequency bands of interest. However, in addition to being costly, it was found that these kinds of tri-band feeds fail to deliver the performance necessary in a reflector dish antenna small enough to find general acceptance among potential subscribers.

Frequency selective surfaces (FSS) have been used as subreflectors on reflector dish antennas for separating signals between a prime focus and an image focus. Frequencies reflected by the FSS are reflected to the image focus of the subreflector while those frequencies to which the FSS is transparent pass through the FSS to the prime focus of the dish reflector. Such an arrangement is shown, for example, by Matson et al. in U.S. Pat. No. 3,231,892. However, FSS technology has been generally limited to military, space and certain specialized applications such as microwave communications systems, and has not been applied in low cost consumer satellite terminals.

SUMMARY OF THE INVENTION

This invention provides a lower cost, higher performance solution to the problem of triband operation of a single dish satellite antenna for providing bundled Ka-band two-way broadband Internet access and Ku-band direct broadcast satellite television service. The novel antenna has a parabolic main reflector dish with an offset prime focal point; a frequency selective surface sub-reflector defining an image focal point; a first feed supported at the prime focal point, a second feed supported at the image focal point; a Ku-band block down-converter low noise amplifier system connected for receiving Ku-band direct broadcast satellite television signals reflected from the dish to one of the first feed and the second feed; a Ka-band transmitter connected to the other one of the one feed and the second feed for illuminating the dish with Ka-band uplink transmissions; and a Ka-band low-noise block-down converter connected for receiving Ka-band downlink signals reflected from the dish to either one of the first feed and said second feed. The dish is mounted on a mast which in turn is fixed to a supporting structure such as a pole or the roof or side wall of a house. The dish mount includes azimuth, elevation and skew adjustments for the dish relative to the mast. Accordingly, two-way Internet access and satellite television service provided by at least two nearly or actually collocated satellites can be delivered to a subscriber by installation of a single ground terminal satellite antenna reflector dish at a subscriber location.

An important advantage of this invention is that it can use a flat or planar frequency selective surface subreflector.

Still another advantage of this invention is that the antenna makes use of readily available, off the shelf, low cost Ku-band DBS components for reception of the DBS TV satellite service.

The satellite antenna includes a feed/transceiver support boom fixed to the dish. The first feed, the second feed, the Ku-band block down-converter low noise amplifier, the Ka-band transmitter and the Ka-band block-down converter low-noise amplifier are all preferably supported on the boom.

Optionally a weather resistant protective enclosure may be provided containing the frequency selective surface and one or both of the first feed and the second feed such that heat generated by operation of the Ka-band transmitter operates to warm the protective enclosure thereby to reduce accumulation of snow and ice thereon.

In one form of the invention the Ka-band transmitter and the Ka band low noise block downconverter are contained in a Ka-band transceiver housing, the housing is supported to the boom, and the second feed and the frequency selective surface are all mounted to the transceiver housing, and including fasteners for detachably supporting the housing to the boom.

In a presently preferred form of the invention the first feed comprises side-by-side Ku-band feed horns and the Ku-band block down-converter low noise amplifier system comprises separate block down-converter low noise amplifier units each operatively associated with one of the Ku-band feed horns such that direct broadcast satellite television signals may be received from two, or more, different satellites spaced along the geostationary arc, and further comprises an adjustment for orientation of the dish in skew relative to the mounting mast.

Another important feature of the novel antenna is that it may be installed in a baseline configuration for delivering broadband Internet access only, and later the antenna may be easily and quickly upgraded in the field to provide DBS satellite TV service at the option of the subscriber. To this end the antenna has a Ku-band subassembly or module removably supported on the boom, the subassembly comprising one or more Ku-band feed horns supported at or near the prime focal point and a Ku-band block down-converter LNA associated with each Ku-band feed horn. The subreflector is interchangeable between a non-selective reflector such as a metal plate subreflector and a frequency selective surface subreflector. The antenna operates in a data only configuration in the absence of the Ku-band module and can be converted from the two way Ka-band data only configuration to the bundled data plus DBS configuration by installation of the Ku-band subassembly on the boom and replacing the metal plate subreflector with a frequency selective surface subreflector.

The Ku band module may have side-by-side Ku-band feed horns and two low noise block down-converter units each operatively associated with one of the Ku-band feed horns, all packaged in a common housing, such that direct broadcast satellite signals may be received from different satellites spaced along the geostationary arc. For purposes of alignment of the side-by-side Ku-band feeds a skew adjustment of the dish relative to said mast may be provided.

The Ka-band transmitter and Ka band receiver can be contained in a Ka-transceiver housing, the Ka-band feed horn also mounted to the transceiver housing, and the transceiver housing detachably supported to the boom.

The invention may also be understood as a method for delivering two-way Internet access and direct broadcast satellite television service to a subscriber by installation of a single satellite antenna reflector dish at a subscriber location. The method includes the steps of providing a Ka-band data satellite and one or more Ku-band direct broadcast satellites, the satellites being nearly or actually collocated along the geostationary arc; providing a satellite antenna at a subscriber location having a single parabolic main reflector dish with an offset prime focal point, two wide-band feed horns, a 20 GHz Ka-band LNBF, a 12 GHz Ku-band LNBF and a 30 GHz Ka-band transmitter, each LNBF and the transmitter having a waveguide connection; connecting one of the feed horns to the waveguide connection of the 20 GHz Ka-band LNBF and the 30 GHz Ka-band transmitter, and the other feed horn to the waveguide connection of the 12 GHz Ku-band LNBF, or alternatively connecting one of the feed horns to the waveguide connection of the 20 GHz Ka-band LNBF and the 12 GHz Ku-band LNBF, and the other feed horn to the waveguide connection of the 30 GHz Ka-band transmitter; providing a flat frequency selective surface subreflector for illuminating the dish with the output of each of the two feed horns; and aligning the dish for simultaneous reception of transmissions from the Ka-band satellite and the Ku-band satellite by the Ka-band LNBF and the Ku-band LNBF respectively and for uplink communication to the Ka-band satellite by the Ka-band transmitter.

The invention also includes a method for upgrading a Ka-band two-way satellite data communications terminal antenna to simultaneously receive Ku-band DBS satellite television reception from a Ku-band direct broadcast satellite nearly or actually collocated along the geostationary arc with a Ka-band data satellite, the antenna having a single parabolic main reflector dish with an off-axis prime focus, a metal plate subreflector defining an image focus, a Ka-band feed horn at the image focus, and a Ka-band transceiver connected to the Ka-band feed horn, the method comprising the steps of replacing the metal plate subreflector with a flat frequency selective surface subreflector and installing one or more Ku-band LNBFs at or near the prime focus of the dish.

In a more general sense the invention is directed to a multi-band antenna comprising a parabolic reflector dish with a prime focus and a frequency selective surface subreflector defining an image focus; a first feed horn at the prime focus and a second feed horn at the image focus; first, second and third radio-frequency communications modules, each of the modules comprising either a radio-frequency transmitter or a radio-frequency receiver, the modules operating on three different frequency bands such that the frequencies of only a first and a second of the frequency bands are related by a factor of approximately two, or less, and a third of the frequency bands is removed from at least one of the first and second frequency bands by a factor greater than two; the two of the modules operating at the first and second of the frequency bands being operatively connected to one of the first and second feed horns and the third of the modules operating at the third frequency band being operatively connected to the other of the first and second feed horns. The frequency selective surface subreflector is preferably a flat surface subreflector and the first and second feed horns are each a wide band feed horn such as a corrugated or scalar aperture wide band feed horn. In a presently preferred form of the multi-band antenna the first of the modules is a 20 GHz band receiver, the second of the modules is a 30 GHz band transmitter and the third of the modules is a 12 GHz band receiver, and the first and second modules are connected to the second feed horn while and the third module is connected to the first feed horn.

These and other features, advantages and improvements of this invention will be better understood by reference to the accompanying detailed description of the preferred embodiment taken in conjunction with the accompanying drawings.

DETAILED DESCRIPTION OF THE PREFERRED EMBODIMENTS

Figure 1:
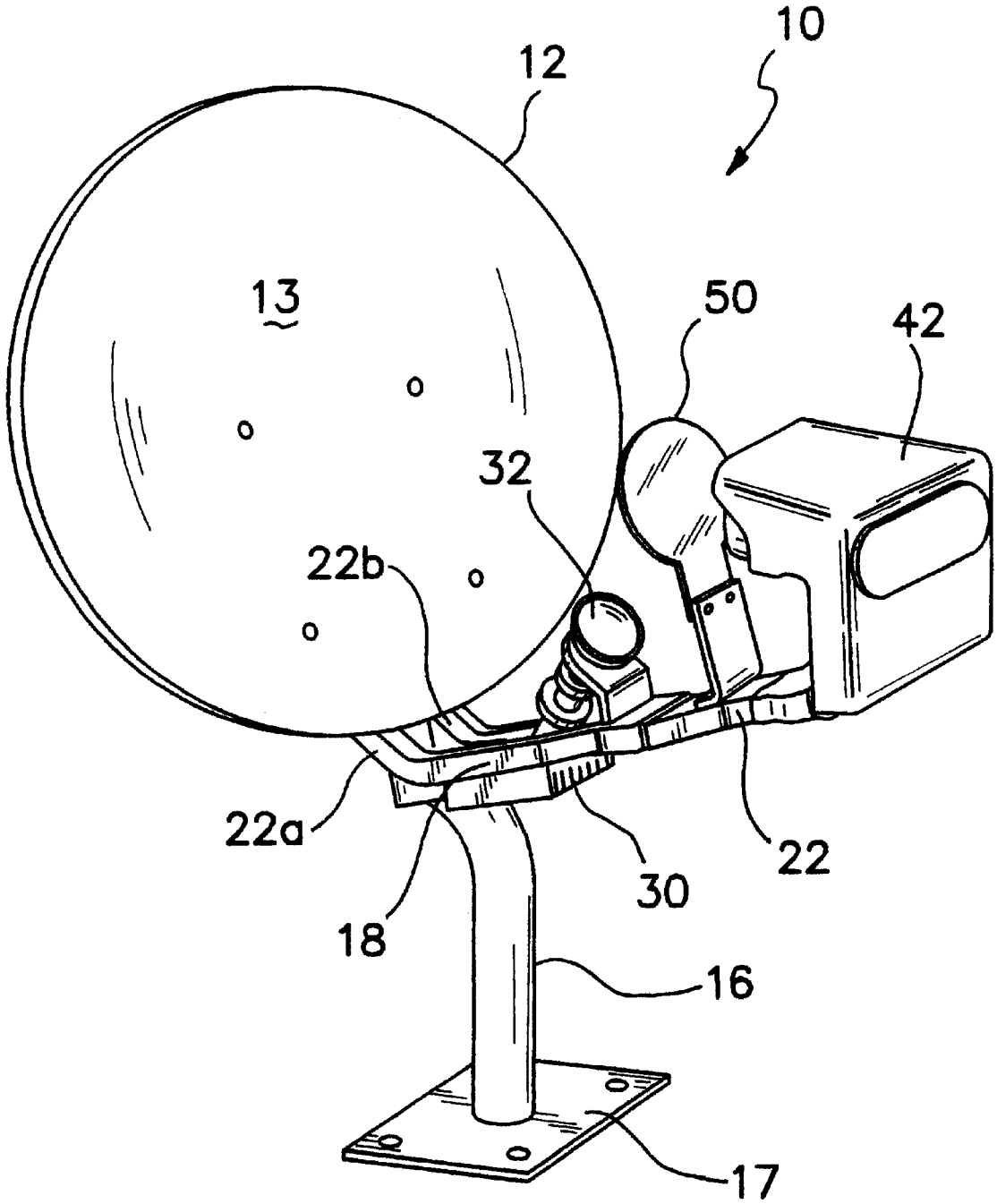
FIG. 1 is a perspective view of the multi-band antenna for bundled broadband satellite Internet access and DBS television service according to this invention.

With reference to the accompanying drawings wherein like elements are designated by like numerals, FIG. 1 shows a satellite ground terminal dish antenna generally designated by the numeral 10. Antenna 10 has a parabolic main reflector dish 12, which is a front fed offset parabolic reflector with a prime focus 11 on the forward concave side 13 of the dish, as seen in the ray diagram of FIG. 2A. The rear, convex side 15 of dish 12 is bolted to a rear support bracket 19 which is adjustably supported on a mounting mast 16 by means of a mounting bracket assembly 14. The mast 16 has a base 17 which is fixed to a supporting structure such as the rooftop of a house or other permanent structure. The mounting bracket assembly 14 may be of conventional design and provides adjustments in azimuth, elevation and skew of the dish reflector 12 relative to the mast 16. The antenna 10 also has an antenna boom 18 rigidly connected to the dish 12 at its rear end 19. Boom 18 extends forwardly from the dish support bracket 14 to a boom end 22 near the prime focus 11. The presently preferred boom design has two parallel, spaced apart beams 22*a,b* joined to each other at a front end 24 of the boom.

Figure 2:
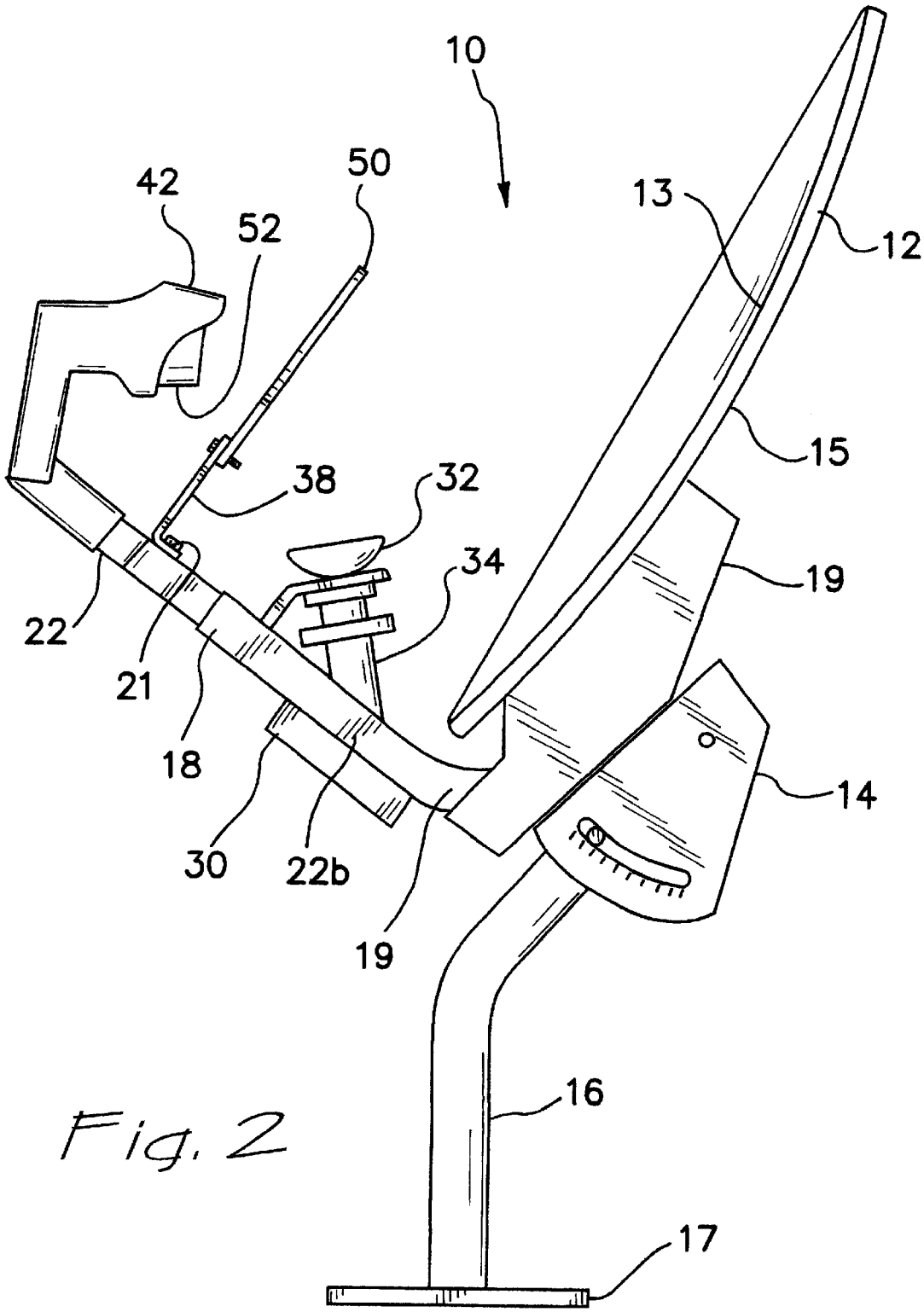
FIG. 2 is a side elevation view of the antenna of FIG. 1.
Figure 2A:
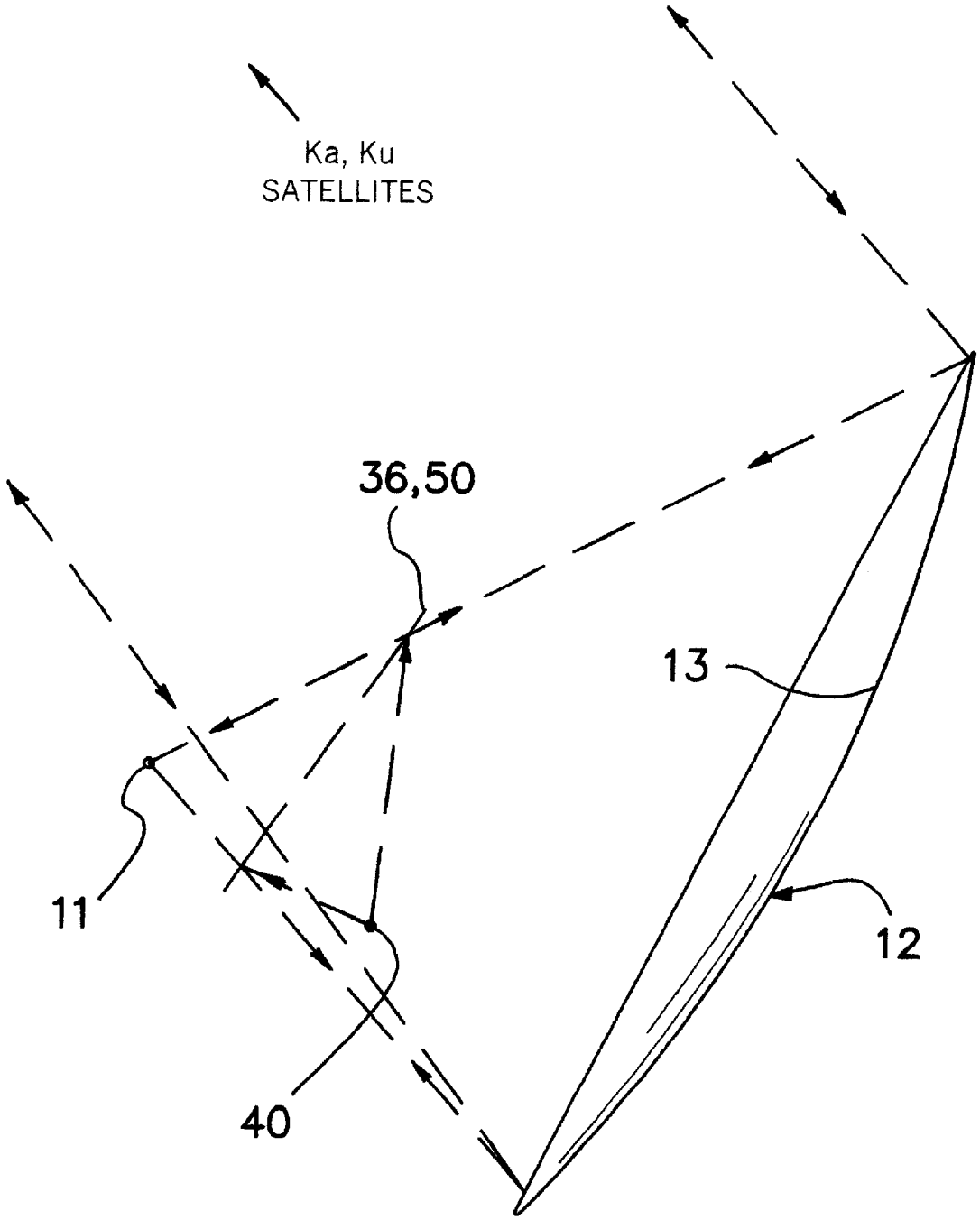
FIG. 2A is an optical ray diagram of the antenna of FIG. 1 showing the prime and image foci of the reflector dish.
Figure 4:
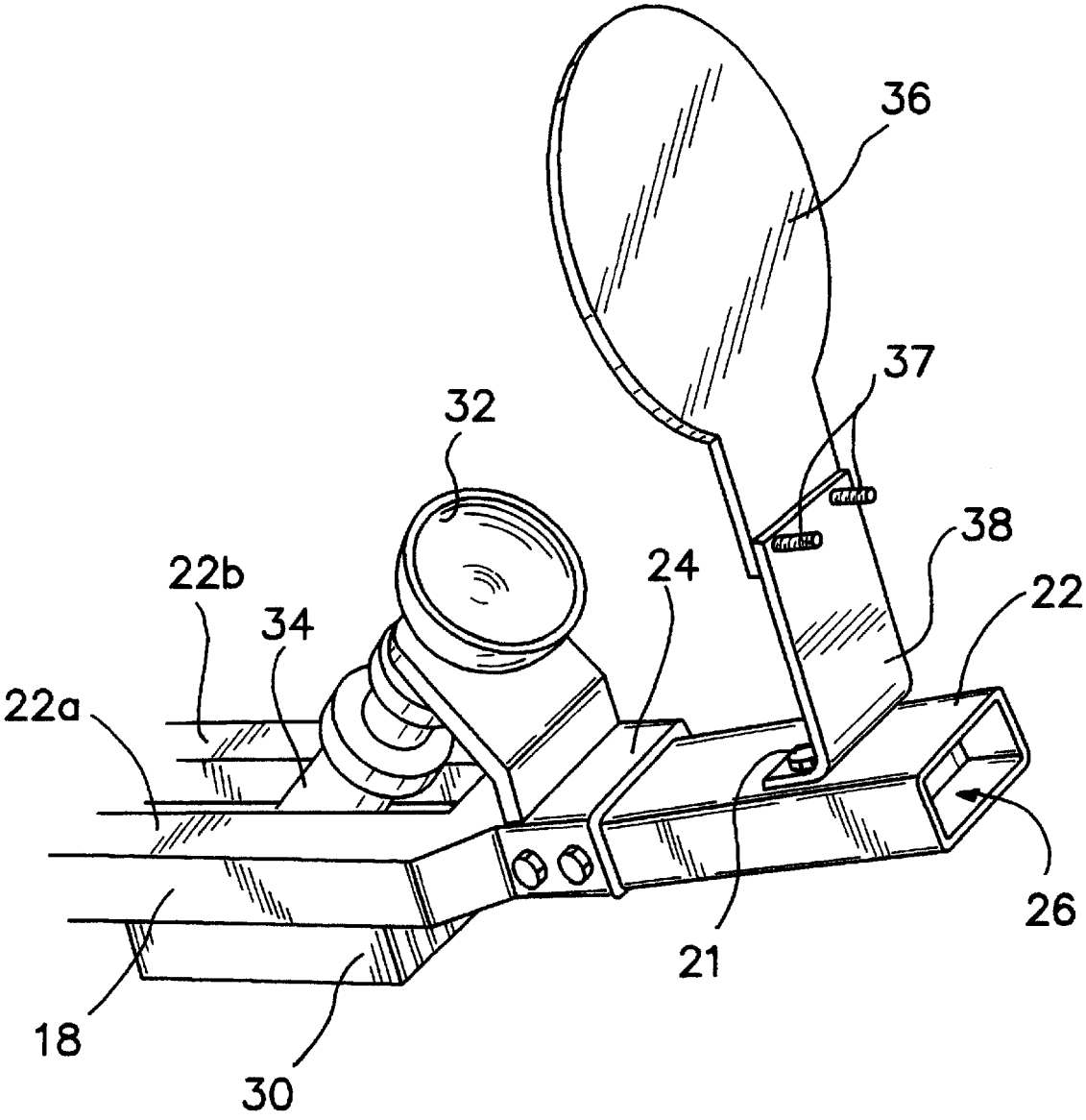
FIG. 4 is an enlarged detail view of the Ka-band feed horn, the subreflector and the end socket on the antenna boom in the baseline Ka-band data only configuration of the antenna of FIG. 1 without the Ku-band receive module.

The antenna 10 has a baseline configuration for Ka-band two-way data communications. In this baseline configuration a Ka-band transceiver 30 is mounted to the underside of antenna boom 18, as shown in FIGS. 1,2 and 4. Transceiver 30 contains a Ka-band block upconverter and power amplifier which receives and intermediate frequency from a data modem located near the subscriber's computer unit, and delivers a 30 GHz uplink or transmit signal to a Ka-band feed horn 32 mounted to the transceiver housing. The feed horn 32 is supported on a rigid waveguide element 34 which extends upwardly between the parallel beams 22*a,b* of the antenna boom 18, and supports the feed horn towards a subreflector 36, as best seen in FIG. 4. The subreflector 36 is secured by means of fastener screw 37 in a holder bracket 38 which is itself attached to boom 18 by a single fastener 21. In the baseline configuration of antenna 10 the subreflector 36 is a metallic disk, positioned for defining an image focus 40 of the main reflector dish, as shown in FIG. 2A. The transceiver 30 also contains a 20 GHz receiver which converts a Ka-band downlink or receive signal to an intermediate frequency for delivery to the indoor data modem, thereby providing two-way data communication with a Ka-band data satellite. The reflector dish 12 is aimed at the data satellite such that the satellite signal is collected by the relatively large reflecting surface 13 of dish 12 and concentrated on subreflector 36 from where the signal is again reflected to converge onto the aperture of feed horn 32. The receive signal is processed by the receiver circuits in a conventional manner to produce the lower intermediate frequency to the data modem. Transmission of the 30 GHz uplink signal occurs in an inverse but optically symmetrical manner with the receive signal as depicted in FIG. 2A: the relatively high power output of the 30 GHz data transmitter in package 30 is emitted as a cone of radio frequency radiation by feed horn 32 onto subreflector 36 from where the signal is reflected onto and illuminates the larger parabolic front surface of dish 12 which in turn reflects the uplink signal as a tight, narrow beam of radiation aimed at the geostationary data satellite.

Figure 3:
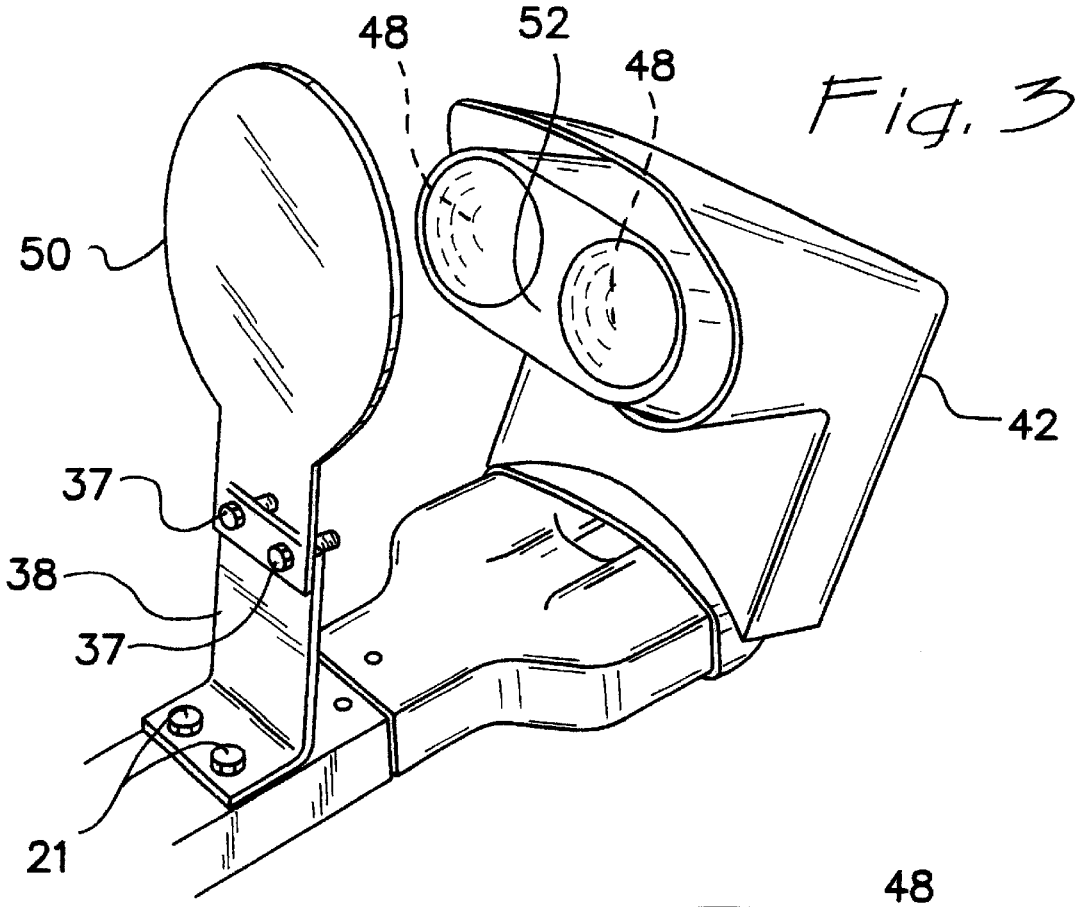
FIG. 3 is an enlarged detail view of the FSS subreflector and dual LNBF Ku-band receive module at the end of the antenna boom of the antenna of FIG. 1.
Figure 5:
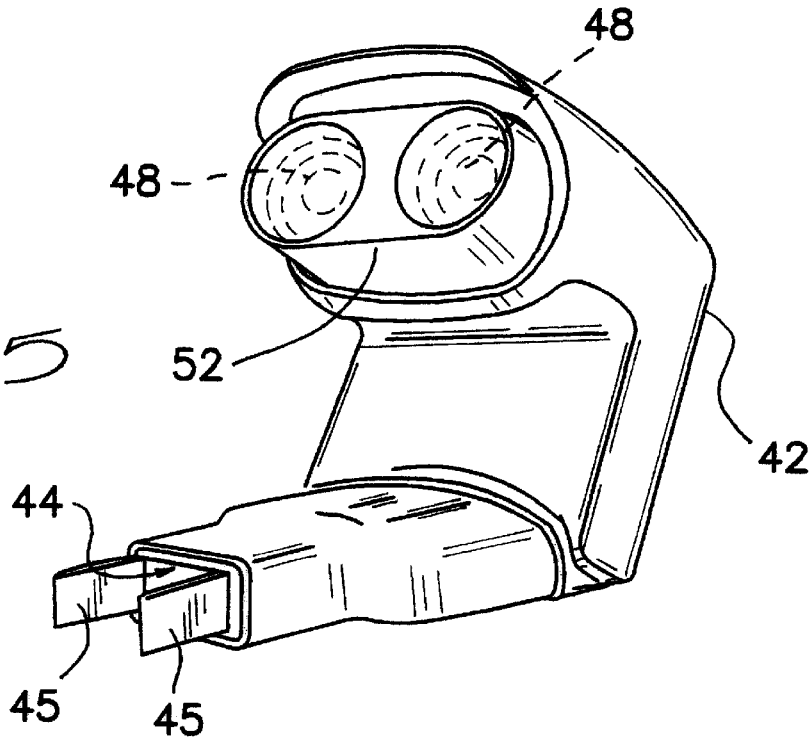
FIG. 5 is a perspective view of the dual LNBF Ku-band receive module for installation in the end socket of the antenna boom of FIG. 4 to upgrade the antenna for bundled Internet access and DBS service.

The antenna 10 may be upgraded at the option of the subscriber to provide Ku-band direct broadcast satellite (DBS) television service bundled with the Ka-band data service. This upgrade is accomplished by installing one or more Ku-band low noise block downconverter feeds (LNBFs) at the end 22 of antenna boom 18. In the presently preferred form of the invention a pair of side-by-side LNBFs packaged as one dual LNBF Ku-band module 42 are installed as depicted in FIGS. 1,2 and 3. The LNBF module 42 is commercially available as an off-the-shelf item from various vendors servicing the general home DBS dish antenna market. One advantage of antenna 10 is the incorporation of such off-the-shelf components which by virtue of large volume production for the general home DBS market have been developed into proven designs readily available at low cost.

The dual LNBF module 42 has suitable RF connectors (not shown in the drawings) recessed in plug 44 which mate with corresponding RF connectors provided in the end socket 26 of boom 18. Module 42 also has prongs 45, which assist in mechanically retaining and locking the module to the mounting socket 26. Module 42 has a pair of Ku-band feed horns 48 indicated in phantom lining and covered by a weather-tight radio frequency transparent cover 52. Each horn 48 is operatively associated and connected with a corresponding Ku-band receiver circuit or low noise block downconverter contained in the module housing. The two Ku-band feed horns 48 lie along a horizontal line when the module 42 is installed on the boom end 22. Upgrade of the antenna 10 also involves replacement of the metal surface subreflector 36 with a frequency selective surface (FSS) subreflector 50. The FSS subreflector 50 is designed and configured to be substantially transparent to 12 GHz band radio frequencies while reflecting higher 20 GHz and 30 GHz frequencies in the Ka-band. These properties of the FSS subreflector are achievable with known design techniques, and the precise dimensions, configuration and characteristics of the FSS subreflector need not be detailed here. However, the use of an FSS subreflector provides an effective and low cost solution to the problem of managing three widely spaced frequency bands between two different feed horns in a combined Ka-data/Ku-DBS single dish satellite antenna. The cost aspect of this solution is particularly helped by use of a flat surface FSS subreflector. This is noteworthy because of the off axis prime focus geometry of the main reflector dish 12, which results in low, grazing angles of incidence of the RF signals against the flat FSS. The use of an offset reflector is virtually necessitated for this application because of applicable FCC regulations limiting permissible off-axis emissions from ground terminal satellite transmitters operating at 30 GHz.

Frequency selective surfaces have been known for a long time. Briefly, the FSS consists of a sheet of dielectric material on which is arranged a closely spaced array of resonant elements. The resonant elements are sized and configured to resonate at the frequencies to be reflected by the FSS. The FSS remains largely transparent to other frequencies. Frequency selective surfaces operate best for angles of incidence close to normal to the FSS surface, and their effectiveness in discriminating between the pass/reflect frequencies falls off as the angle of incidence of the RF radiation increases away from the normal. This difficulty has been addressed in the present invention by treatment of the FSS surface with dielectric materials having a very high dielectric coefficient, such that the angle of incidence increases towards the normal at the transition from air into the dielectric layer. The very high dielectric layer is spaced from the actual FSS surface by very low-density foam. In effect the incident RF radiation is refracted by the change in dielectric coefficient so that the radiation impinges upon the underlying FSS at a closer to normal angle, thus improving the effectiveness of the FSS subreflector. The treated flat FSS subreflector 50 used in antenna 10 was developed for the applicants at the Ohio State University Electro-Science Laboratory by Professor Ben A. Monk, retired but still associated with Ohio State University, and by his students and associates, including Professor Walter D. "Denny" Burnside. Information relating to FSS design and FSS surface treatments is also provided in Professor Monk's treatise on the subject entitled "Frequency Selective Surfaces, Theory and Design"published by John Wiley and Sons, Inc. Copyright 2000. While the aforementioned surface coating and dielectric treatment of the FSS is desirable, the antenna 10 can also function, although at a substantially diminished level of performance, with a flat FSS lacking the dielectric surface coating.

The desirability of special dielectric coating can be avoided by resorting to a curved surface FSS subreflector, where the curved surface results in a closer to normal angle of incidence of the RF signals. However, curved surface FSS devices are far more difficult to make and considerably more expensive than flat surface FSS devices, and a low cost mass production antenna such as contemplated in this disclosure is not economically feasible using a curved FSS subreflector. Nonetheless, in alternate forms of the invention the FSS subreflector may be concavely or convexly curved, such as elliptically or hyperbolically curved in Gregorian or Cassegrain optical configurations.

Small dish size is a central design constraint in a product intended for the home market. In order to keep the size of the reflector dish 12 small, it is necessary to make the most efficient use of the available reflecting surface of the dish, that is, to maximize antenna gain for a given, relatively small antenna aperture. Therefore, one design objective is to illuminate the dish surface as fully and evenly as possible with the transmit and receive signal feeds.

As previously mentioned, antenna 10 is required to handle three widely separated frequency bands, namely the 12 GHz Ku-band for DBS television service and the two frequency bands involved in two-way Ka-band communication, the 30 GHz uplink band and the 20 GHz downlink band. Since it is undesirable to use three separate feeds, one for each frequency band, at least one of the feeds must operate over a frequency range encompassing two of the frequency bands of interest. At the same time, it is desirable to use existing feed technology already proven in the mass DBS television market in order to keep low the cost of the antenna. The standout choice for a wide band, low cost feed is the corrugated or scalar aperture feed horn, a high performance device which is mass produced inexpensively of cast aluminum. Corrugated feed horns are widely used in mass market Ku-band DBS LNBF's and it also desirable to use such a feed horn in conjunction with the Ka-band transmit and receive functions of antenna 10. However, corrugated feed horns are generally limited to operation over a range of frequencies where the highest frequency is normally no more than twice the lowest frequency, that is, a 2-to-1 frequency range. This limits a given feed horn design to operation over only two of the three frequency bands of interest to antenna 10: a combination of the two Ka transmit/receive bands or of the Ku DBS receive band with the Ka receive band. In antenna 10, the third frequency band which is related to at least one of the other two frequency bands by a factor greater than two is assigned a second feed horn, and as already described, one feed horn is positioned at the prime focus and the second feed horn is positioned at the image focus of dish 12 defined by the FSS subreflector.

In the presently preferred configuration of the multi-band antenna 10, both Ka transmit and receive frequency bands are assigned to a common corrugated first feed horn 32. This enables the use of existing Ku LNBFs modules developed for the mass DBS market, each module having an integrated corrugated feed horn 48 each of which functions as the second feed horn, thereby minimizing component cost of the multi-band antenna 10.

This preferred configuration offers the further advantage of being easily field upgradeable at a subscriber location from an installed baseline Ka-band only configuration to an upgraded configuration featuring bundled Ka-band Internet access and Ku-band DBS television service.

In the baseline configuration of the antenna 10 shown in FIG. 4 the antenna is installed with only the Ka-band transceiver unit 30 and a subreflector 36 having a conventional radio frequency reflective surface, such as a simple flat metal disk, which is not frequency selective. A nonselective subreflector 36 is preferred in a baseline installation because of its very low cost, typically a small fraction of the cost of a flat FSS subreflector 50.

At the option of the service subscriber the installed antenna 10 can be upgraded simply by installing a Ku-band LNBF module 42 at the prime focus 11 of the antenna. This is a plug-in operation by electrically and mechanically fitting the LNBF module into the end socket 26 provided at the end of antenna boom 18. The electrical connectors (not shown in the drawings) in the socket 26 establish the necessary radio frequency and DC power connections between the LNBF module 42 and the subscriber's indoor DBS television receiver unit 66. The upgrade is completed by removing the nonselective subreflector with its bracket 38 and installing in its place a FSS subreflector 50 of similar configuration. The entire upgrade operation can done in a few minutes and need not require any adjustment to the antenna's existing alignment with the Ka-band data satellite.

Figure 6:
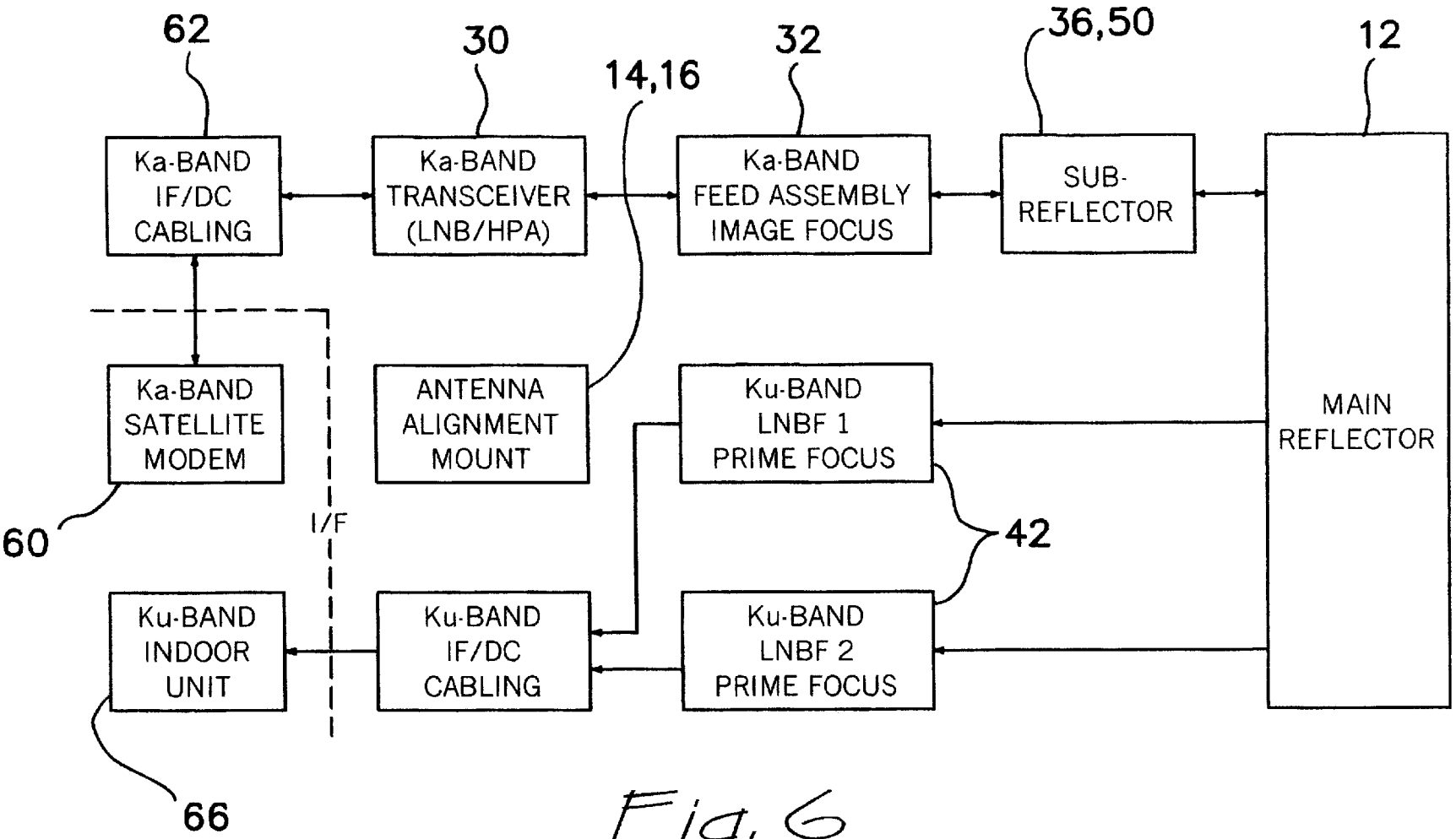
FIG. 6 is a functional block diagram of the antenna of FIG. 1.

As indicated in the block diagram of FIG. 6, the antenna also includes suitable cabling 62 for the Intermediate Frequency signals and DC power connection between the transceiver 30 and the subscriber's indoor Ka-band satellite modem 60, as well as cabling 64 for the Intermediate Frequency signals and DC power connection between the Ku-band module 42 and the Ku-band indoor unit 66. FIG. 6 also illustrates the main components of the antenna 10 and their operational relationship in the upgraded configuration shown in FIG. 1.

The multi-band antenna 10 in the upgraded configuration of FIGS. 1,2 and 3 is intended for operation with two or more communications satellites which are nearly or actually collocated along the geostationary satellite arc. This is the case, for example, with the satellite constellation consisting of the five satellite listed in Table 1 below:

TABLE 1

Satellite Locations

| Designation | ID | Description | Location (deg) |
|---|---|---|---|
| WildBlue-1 | WB-1 | Ka-band Two-Way Spot Beam Communications Satellite | 109.2 W |
| WildBlue-2 | WB-2 | Ka-band Two-Way Spot Beam Communications Satellite | 111.1 W |
| Ku-band-1 | KU-1 | Ku-band Direct Broadcast Satellite | 119.0 W |
| Ku-band-2 | KU-2 | Ku-band Direct Broadcast Satellite | 110.0 W |
| Ku-band-3 | KU-3 | Ku-band Direct Broadcast Satellite | 101.0 W |

In this case, the antenna 10 can be configured to service any of the following five subsets of the five satellites of Table 1:

TABLE 2

Antenna Configurations

| Designation | ID | Satellites Supported |
|---|---|---|
| Ka-band Only | A | WB-1 or WB-2 |
| WB1 West | B | WB-1, KU-1 and KU-2 |
| WB1 East | C | WB-1, KU-2 and KU-3 |
| WB2 West | D | WB-2, KU-1 and KU-2 |
| WB2 East | E | WB-2, KU-2 and KU-3 |

The baseline configuration of the antenna provides Ka-band only service ID A. When upgraded with a dual LNBF 42 module antenna 10 can service two Ku-band DBS satellites in addition to the Ka-band data satellite. The upgraded configuration of antenna 10 can support any combination of three satellites of ID B, C, D and E. The locations of the feed horns 48 of the two Ku LNBFs may not be optimal relative to the dish prime focal point 11 because normally optimal reception of the Ka-band data signal will be given priority when positioning and aiming the antenna dish 12. Nonetheless, because of the efficiency of the FSS subreflector 50, a 26-inch diameter dish with a vertex approximately 2 inches below the bottom edge of the reflector 12 and focal length of approximately 20 inches has been found to provide satisfactory Ku-band DBS signal reception from two Ku satellites together with good two-way Ka-band data performance.

The antenna configuration illustrated in the drawings, while presently preferred, can be altered by reversing the positions of the Ku-band module 42 and the Ka-band transceiver 30 relative to the subreflector, by placing the Ku-band LNBF module 42 at the image focus 40 of the antenna and the feed horn of the Ka-band transceiver at the prime focus 11, with appropriate modification to the boom 18 and relocation of the end socket 26.

Still other alternative configurations of the antenna are possible, involving different assignments of the three frequency bands as between two different feed horns of the antenna. For example, the Ku-band receive signal can be paired with either of the Ka-band transmit or receive signals in one feed horn, which can be located at either the prime or image focus of the antenna. Such alternative configurations are not presently preferred because they cannot be implemented using existing Ku-band DBS reception modules and would require development of custom components, leading to considerably greater final cost of the antenna.

More generally this invention provides a multi-band antenna useful in any application where three radio frequency receiver or transmitter modules are operated with a single dish antenna and the three modules operate on three frequency bands and which need not be limited to the Ka-bands and Ku-band applications described above.

While a particular preferred embodiment has been described and illustrated for purposes of example and clarity it must be understood that many changes, substitutions and modifications to the described embodiment will become apparent to those having only ordinary skill in the art without thereby departing from the scope of this invention as defined in the following claims.

What is claimed as new is:

1. A satellite antenna for providing bundled Ka-band two-way communications services such as broadband Internet access and Ku-band direct broadcast satellite television service, comprising:

a parabolic main reflector dish having an offset prime focal point;

a frequency selective surface sub-reflector defining an image focal point;

a first feed supported at said prime focal point;

a second feed supported at said image focal point;

a Ku-band low noise block down-converter system connected for receiving Ku-band direct broadcast satellite television signals reflected from said dish to one of said first feed and second feed;

a Ka-band transmitter connected to the other of said one feed and said second feed for illuminating said dish with Ka-band uplink signal transmissions;

a Ka-band low-noise block-down converter connected for receiving Ka-band downlink signals reflected from said dish to either one of said first feed and said second feed; and a mast for mounting said dish to a supporting structure;

whereby two-way Internet access and satellite television service provided on at least two nearly or actually collocated satellites can be delivered to a subscriber by installation of a single satellite antenna reflector dish at a subscriber location.

2. The satellite antenna of claim 1 wherein said frequency selective surface is a flat or contoured surface.

3. The satellite antenna of claim 1 further comprising a feed/transceiver support boom fixed to said dish and said first feed, said second feed, said Ku-band low noise block down-converter, said Ka-band transmitter and said Ka-band low-noise block-down converter are all supported on said boom.

4. The satellite antenna of claim 1 wherein said first feed comprises side-by-side Ku-band feed horns and said Ku-band low noise block down-converter system comprises independent low noise block down-converter units each operatively associated with one of said Ku-band feed horns such that direct broadcast satellite television signals may be received from different Ku-band DBS satellites spaced along the geostationary arc.

5. A satellite antenna convertible between a two-way Ka-band data only configuration and a bundled Ka-band data-Ku-band DBS configuration, or the inverse, comprising:

a parabolic main reflector dish having an offset prime focal point;

a support boom affixed to said reflector dish;

a subreflector on said boom defining an image focal point of said dish reflector a Ka-band transceiver supported on said boom, said transceiver having a Ka-band transmitter, a Ka band low noise block downconverter and a Ka-band feed horn mounted at said image focal point for illuminating said subreflector;

a Ku-band subassembly removably supported on said boom, said subassembly comprising a Ku-band feed supported at said prime focal point and a Ku-band low noise block down-converter system; and said subreflector being interchangeable between a non-selective subreflector and a frequency selective surface subreflector;

whereby said satellite antenna operates in said data only configuration in the absence of said Ku-band subassembly and can be converted from the two way Ka-band data only configuration to the bundled configuration by installation of said Ku-band subassembly on said boom and a frequency selective surface as said subreflector.

6. The satellite antenna of claim 5 wherein said Ku band feed comprises a pair of side-by-side Ku-band feed horns and said Ku-band low noise block down-converter system comprises two independent low noise block down-converter units each operatively associated with one of said Ku-band feed horns such that direct broadcast satellite television signals may be received from two different satellites spaced along the geostationary arc.

7. The satellite antenna of claim 5 wherein said Ka-band transmitter and said Ka band low noise block downconverter are contained in a Ka-transceiver housing, said Ka-band feed horn is mounted to said housing, and said housing is detachably supported to said boom.

8. A method for delivering two-way communications services such as Internet access and direct broadcast satellite television service to a subscriber by installation of a single satellite antenna reflector dish at a subscriber location, comprising the steps of:

providing a Ka-band data satellite and a Ku-band direct broadcast satellite, the two satellites being nearly or actually collocated along the geostationary arc;

providing a satellite antenna at a subscriber location having a single parabolic main reflector dish with an offset prime focal point, two wide-band feed horns, a 20 GHz Ka-band LNBF, a 12 GHz Ku-band LNBF and a 30 GHz Ka-band transmitter, each said LNBF and said transmitter having a waveguide connection;

connecting one of said feed horns to said waveguide connection of said 20 GHz Ka-band LNBF and said 30 GHz Ka-band transmitter, and the other feed horn to said waveguide connection of said 12 GHz Ku-band LNBF, or alternatively connecting one of said feed horns to said waveguide connection of said 20 GHz Ka-band LNBF and said 12 GHz Ku-band LNBF, and the other feed horn to said waveguide connection of said 30 GHz Ka-band transmitter;

providing a flat or contoured frequency selective surface subreflector for illuminating said dish with the output of each of said two feed horns; and aligning said dish for simultaneous reception of transmissions from said Ka-band satellite and said Ku-band satellite by said Ka-band LNBF and said Ku-band LNBF respectively and for uplink communication to said Ka-band satellite by said Ka-band transmitter.

9. A method for upgrading a Ka-band two-way satellite data communications terminal antenna for Ku-band DBS satellite television reception from a Ku-band direct broadcast satellite nearly or actually collocated along the geostationary arc with a Ka-band data satellite, said antenna having a single parabolic main reflector dish with an off-axis prime focus, a metal plate subreflector defining an image focus, a Ka-band feed horn at said image focus, and a Ka-band transceiver connected to said Ka-band feed horn, said method comprising the steps of:

replacing said metal plate subreflector with a flat frequency selective surface subreflector and installing one or more Ku-band LNBFs at or near said prime focus of said dish.

10. A tri-band, or multi-band, antenna comprising:

a parabolic reflector dish with a prime focus and a frequency selective surface subreflector defining an image focus;

a first feed horn at said prime focus and a second feed horn at said image focus; and first, second and third radio-frequency communications modules, each of said modules comprising either a radio-frequency transmitter or a radio-frequency receiver, said modules operating on three different frequency bands such that the frequencies of only a first and a second of said bands are related by a factor of approximately two and a third of said frequency bands is removed from at least one of said first and second frequency bands by a factor greater than two;

the two of said modules operating at said first and said second of said bands being operatively connected to one of said first feed horn and said second feed horn and the third of said modules operating at said third frequency band being operatively connected to the other of said first feed horn and said second feed horn.

11. The tri-band, or multi-band, antenna of claim 10 wherein said frequency selective subreflector is a flat, or contoured, surface subreflector.

12. The tri-band, or multi-band, antenna of claim 10 wherein said first feed horn and said second feed horn are each a wide band feed horn.

13. The tri-band, or multi-band, antenna of claim 10 wherein said first feed horn and said second feed horn are each a corrugated wide band feed horn.

14. The tri-band, or multi-band, antenna of claim 10 wherein said prime focus is offset from the axis of said parabolic reflector dish.

15. The tri-band, or multi-band, antenna of claim 10 wherein said first of said modules is a 20 GHz band receiver, said second of said modules is a 30 GHz band transmitter and said third of said modules is a 12 GHz band receiver and the first and second modules are connected to said second feed horn and said third module is connected to said first feed horn.

* * * * *